US006396371B2

(12) United States Patent
Streeter et al.

(10) Patent No.: US 6,396,371 B2
(45) Date of Patent: May 28, 2002

(54) MICROELECTROMECHANICAL MICRO-RELAY WITH LIQUID METAL CONTACTS

(75) Inventors: Robert D. Streeter; Lee A. McMillan; Roderick G. Bergstedt, all of Fort Wayne, IN (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/775,430

(22) Filed: Feb. 1, 2001

Related U.S. Application Data

(60) Provisional application No. 60/179,829, filed on Feb. 2, 2000.

(51) Int. Cl.[7] ..... H01H 51/22
(52) U.S. Cl. ..... 335/78; 335/47; 335/58
(58) Field of Search ..... 335/47–49, 50, 335/51, 52–58, 78–86; 200/233–5, 192–3; 257/414, 421, 531

(56) References Cited

U.S. PATENT DOCUMENTS

| | | | | |
|---|---|---|---|---|
| 3,815,816 A | * | 6/1974 | Scarelli | 337/26 |
| 3,904,999 A | | 9/1975 | Rich et al. | |
| 4,066,859 A | | 1/1978 | Steinmetz | |

(List continued on next page.)

FOREIGN PATENT DOCUMENTS

| | | |
|---|---|---|
| FR | 2 394 881 A | 1/1979 |
| GB | 2 052 871 A | 1/1981 |
| JP | 01089224 A | 3/1989 |

(List continued on next page.)

OTHER PUBLICATIONS

Y. Komura et. al. "Micro Machined Relay for High Frequency Application", pp. 12–1–12–5. (No date).

K. Sano et. al. "Study on Characteristics of Micro Machined Relay With Atmosphere Control", pp. 2–1–2–5. (No date).

Jonathan Simon et. al. "A Liquid—Filled Microrelay with a Moving Mercury Microdrop", Journal of Microelectromechanical Systems, vol. 6, No. 3, Sep. 1997, pp. 208–216.

William P. Taylor et. al. "Fully Integrated Magnetically Actuated Micromachined Relays", Journal of Microelectromechanical Systems, vol. 7, No. 2, Jun. 1998, pp. 181–191.

T.S. Sudarshan et al.; "Wetting of metal surfaces with a liquid metal using a plasma interaction technique"; J. Vac. Sci. Technol. A2(4), Oct.–Dec. 1984; pp. 1503–1508.

Stewart Low; "Modified Atmosphere to Extend Contact Rating"; Electronic Specialty Corp.; pp. 10–1–10–4. (No date).

Alok Awasthi et al.; "Measurement of contact angle in systems involving liquid metals"; Mass. Sci. Technol. 7 (1996) 753–757. (No month).

(List continued on next page.)

*Primary Examiner*—Lincoln Donovan
*Assistant Examiner*—Tuyen T. Nguyen
(74) *Attorney, Agent, or Firm*—Daly, Crowley & Mofford, LLP

(57) ABSTRACT

A MEM relay includes an actuator, a shorting bar disposed on the actuator, a contact substrate, and a plurality of liquid metal contacts are disposed on the contact substrate such that the plurality of liquid metal contacts are placed in electrical communication when the MEM relay is in a closed state. Further, the MEM relay includes a heater disposed on said contact substrate wherein said heater is in thermal communication with the plurality of liquid metal contacts. The contact substrate can additionally include a plurality of wettable metal contacts disposed on the contact substrate wherein each of the plurality of wettable metal contacts is proximate to each of the plurality of liquid metal contacts and each of the wettable metal contact is in electrical communication with each of the plurality of liquid metal contacts.

27 Claims, 8 Drawing Sheets

U.S. PATENT DOCUMENTS

| | | | |
|---|---|---|---|
| 4,085,392 | A | 4/1978 | Lacis et al. |
| 4,199,739 | A | 4/1980 | Deith |
| 4,263,342 | A | 4/1981 | Zakurdaev et al. |
| 4,311,769 | A | 1/1982 | Andreev et al. |
| 4,368,442 | A | 1/1983 | Yamaguchi et al. |
| 4,400,671 | A | 8/1983 | Legrand |
| 4,471,190 | A | 9/1984 | Pouyez |
| 4,572,934 | A | 2/1986 | Johnston |
| 4,652,710 | A | 3/1987 | Karnowsky et al. |
| 4,804,932 | A | 2/1989 | Akanuma et al. |
| 5,391,846 | A | 2/1995 | Taylor et al. |
| 5,686,875 | A | 11/1997 | Bollen |
| 5,912,606 | A | 6/1999 | Nathanson et al. |

FOREIGN PATENT DOCUMENTS

| | | | |
|---|---|---|---|
| JP | 04133216 | A | 7/1992 |
| JP | 04345717 | A | 12/1992 |
| JP | 06 089649 | | 6/1994 |
| JP | 10255597 | A | 9/1998 |
| JP | 09293895 | | 5/1999 |

OTHER PUBLICATIONS

Friedrich Hensel et al.; "Critical behaviour in liquid mercury"; Section 3 Metal–non–metal transition: expanded metals and compressed non–metals; Journal of Non–Crystalline Solids (1996); pp. 231–238. (No month).

Paul M. Zavracky et al.; "Micromechanical Switches Fabricated Using Nickel Surface Micromachining"; Journal of Microelectromechanical Systems, vol. 6, No. 1; Mar. 1997; IEEE; pp. 3–9.

J. Y. Park et al.; "Development of magnetic materials and processing techniques applicable to integrated micromagnetic devices"; J. Micromech. Microeng. 8 (1998); pp. 307–316.

Camille Vanlangendonck; "Kontakt In Allen Lagen"; pp. 37–38, 40, 43. (No Translation) (No date).

Richard Remington et al.; "Reed switches–long life in harsh applications"; Controls/Switches/Drives; Sep. 17, 1973; Electronic Products Magazine; pp. 93–100, 103.

Evaluation Of Amalgamated Metallic Surfaces For Reducing Friction, Contact Resistance, and Wear In Electrical Contact Applications; NTIS; Nov. 1974; U.S. Department of Commerce; pp. 1–31.

Daniel Hyman et al.; "Contact Physics of Gold Microcontacts for MEMS Switches". (No date).

Robert W. Dobson; "A Military Contractor's Experience with RF Coaxial Relays"; 1999 EIA; pp. 1–11. (No month).

Daniel J. Hyman et al.; "Power Handling of Ohmic–Contact Microfabricated RF Relays" HRL Laboratories; pp. 14–2–14–6. (No date).

Werner Johler; "Electro Negative Gases—A Basic Technology for Enhanced Performance of Telecom Relays"; AXICOM Ltd.; pp. 1–1–1–14. (No date).

Junghoon Lee et al.; "Surface–Tension–Driven Microactuation Based on Continuous Electrowetting"; Journal of Microelectromechanical Systems; vol. 9, No. 2; Jun. 2000; pp. 171–180.

Lisen Tang et al.; "Study on the subminiaturized technique of mercury–wetted contact relay"; vol. 28, No. 9; Dec. 1994; pp. 83–88. (No Translation).

D. Trowbridge; "Switching with the mercury–wetted contact relay"; Electronics & Power; Aug. 1976; pp. 523–525.

T.S. Sudarshan et al.; "Wetting of aluminum electrodes with mercury"; J. Appl. Phys. 56(8); Oct. 15, 1984; pp. 2236–2240.

"Liquid Metal Conductors"; Liquid Crystals; pp. 2548–2550. (No date).

Chong H. Ahn et al.; "Micromachined Planar Inductors With Electroplated Nickel–Iron Permalloy Cores"; Electrochemical Society Proceedings; vol. 95–18; pp. 411–425. (No date).

J. Simon et al., "Lateral Polysilicon Microrelays with a Mercury Microdrop Contact", IEEE Transactions on Industrial Electronics, New York, vol. 45, No. 6, Dec. 1, 1998, pp. 854–860.

* cited by examiner

MICROELECTROMECHANICAL MICRO-RELAY WITH LIQUID METAL CONTACTS

CROSS-REFERENCE TO RELATED APPLICATIONS

This application claims priority under 35 U.S.C. §119(e) from U.S. provisional application No. 60/179,829 filed on Feb. 2, 2000.

FIELD OF THE INVENTION

The present invention relates to electrical and electronic circuits and components. More specifically, the present invention relates to micro-electromechanical (MEM) relays with liquid metal contacts.

BACKGROUND OF THE INVENTION

A MEM switch is a switch operated by an electrostatic charge, thermal, piezoelectric or other actuation mechanism and manufactured using micro-electromechanical fabrication techniques. A MEM switch may control electrical, mechanical, or optical signal flow. Conventional MEM switches are usually single pole, single throw (SPST) configurations having a rest state that is normally open. In a switch having an electrostatic actuator, application of an electrostatic charge to the control electrode (or opposite polarity electrostatic charges to a two-electrode configuration) will create an attractive electrostatic force ("pull") on the switch causing the switch to close. The switch opens by removal of the electrostatic charge on the control electrode(s), allowing the mechanical spring restoration force of the armature to open the switch. Actuator properties include the required make and break force, operating speed, lifetime, sealability, and chemical compatibility with the contact structure.

A micro-relay includes a MEM electronic switch structure mechanically operated by a separate MEM electronic actuation structure. There is only a mechanical interface between the switch portion and the actuator portion of a micro-relay. When the switch electronic circuit is not isolated from the actuation electronic circuit, the resultant device is usually referred to as a switch instead of a micro-relay. MEM devices are typically built using substrates compatible with integrated circuit fabrication, although the electronic switch structure disclosed herein does not require such a substrate for a successful implementation. MEM micro-relays are typically 100 micrometers on a side to a few millimeters on a side. The electronic switch substrate must have properties (dielectric losses, voltage, etc.) compatible with the desired switch performance and amenable to a mechanical interface with the actuator structure if fabricated separately.

MEM switches are constructed using gold or nickel (or other appropriate metals) as contact material for the device. Current fabrication technology tends to limit the type of contact metals that can be used. The contacts fabricated in a conventional manner tend to have lifetimes in the millions of cycles or less. One of the problems encountered is that microscale contacts on MEM devices tend to have very small regions of contact surface (typically 5 micrometers by 5 micrometers). The portion of the total contact surface that is able to carry electrical current is limited by the microscopic surface roughness and the difficulty in achieving planar alignment of the two surfaces making mechanical and electrical contact. Thus, most contacts are point contacts even on a surface that would seem to have hundreds or thousands of square micrometers of contact surface available. The high current densities in these small effective contact regions create microwelds and surface melting, which if uncontrolled results in impaired or failed contacts. Such metallic contacts tend to have short operational lifetimes, usually in the millions of cycles.

The state of the art in macro-scale relays/switches is well developed. There has been a considerable effort in developing long life contact metallurgy for the signal contacts. The signal contact life and the appropriate contact metallurgy tends to be rated by the application, such as "dry" signals (no significant current or voltage), inductive loads and high current loads.

It is known in the art, that electrical contacts using mercury (chemical symbol Hg) as an enhancement for switch contact conductivity yields longer contact life. It is also known that the Hg enhanced contacts are capable of operating at higher current than the same contact structure without mercury. Mercury wetted reed switches are an example. Other examples or mercury wetted switches are described in U.S. Pat. Nos. 5,686,875, 4,804,932, 4,652,710, 4,368,442, 4,085,392 and Japanese application 03118510 (Publication No. JP04345717A).

The use of mercury droplets in a miniature relay (a device which is much larger than a MEM relay) controlled by a high voltage electrostatic signal is taught in U.S. Pat. No. 5,912,606. U.S. Pat. No. 5,912,606 uses the electrostatic signal on a gate to attract liquid metal drawn from a first contact to liquid metal drawn from a second contact or to draw liquid metal from both contacts to a shorting conductor mounted on the gate in order to electrically connect the contacts.

A conventional vertically activated surface micromachined electrostatic MEM micro-relay 10 structure is shown in FIG. 1. The MEM micro-relay 10 includes a single substrate 30 on which is micromachined a cantilever support 34. A first signal contact 50, a second signal contact 54, and a first actuator control contact 60*a* are disposed on the same substrate 30. The contacts have external connections (not shown) in order to connect the micro-relay to external signals. One end of a cantilever 40 is disposed on cantilever support 34. Cantilever 40 includes a second actuator control contact 60*b*. A second end of the cantilever 40 includes a shorting bar 52. The two conductive actuator control contacts 60*a* and 60*b* control the actuation of the MEM micro-relay 10.

Without a control signal, the shorting bar 52 on the cantilever 40 is positioned above the substrate 30 by the support 34. With the cantilever 40 in this position, the first and second signal contacts 50 and 54 on the substrate 30 are not electronically connected. An electrostatic force created by a potential difference between the second actuator control contact 60*b* and the first actuator control contact 60*a* on substrate 30 control connection is used to pull the cantilever 40 down to toward the substrate 30. The MEM micro-relay 10 uses the conductive shorting bar 52 to make a connection between the two signal contacts 50 and 54 attached to the same substrate 30 as the cantilever 40 and cantilever support 34. When pulled to the substrate 30, the shorting bar 52 touches the first and second signal contacts 50 and 54 and electrically connects them together. The cantilever 40 typically has an insulated section (not shown) separating the shorting bar 52 from the cantilever electrostatic actuator control contact 60*b*. Thus, the first and second signal contacts 50 and 54 are connected by the cantilever 40 shorting bar 52, which is operated by an isolated electrostatic force mechanism using the two actuator control contacts 60*a* and 60*b* surfaces. The contacts 50, 54 and the shorting bar 52 typically have short operational lifetimes due to the problems described above.

The micromachined electrostatic MEM micro-relay 10 is shown as a normally open (NO) switch contact structure. The open gap between the actuator control contact 60*a* and the cantilever beam 40 is usually a few microns (1/1,000,000 meter) wide. The gap between the shorting bar and the signal contacts is approximately the same dimension. When the switch closes, the cantilever beam 40 is closer to but not in direct electrical contact with actuator control contact 60*a*.

If the signal contact metal is wettable with mercury, and the rest of the micro-relay is not wettable, then the mercury could be deposited on the signal metalization and allowed to flow into the active contact area under the cantilever by capillary action. The problem of mercury bridging at these close spacings must be addressed. When the mercury contacts are not contained, the contacts are subject to all the problems described in the above referenced patents including splashing and the need for liquid metal replenishment.

Mercury contacts represent a major challenge for the conventional MEM switch. The typical physical separation between the contacts on the substrate and the shorting bar is a few micrometers to a few tens of micrometers. Placing mercury on the contact surfaces during the fabrication of the micro-relay requires that the chemical process be compatible with mercury or other liquid metals. Mercury has limited or no compatibility with typical CMOS processes used to fabricate vertical structure micro-relays.

The close separation between the shorting bar and the contacts makes it difficult to insert mercury on the contacts after the micro-relay is fully operational. Applying a mercury wetting to the fully functional contact and shorting bar surfaces would be difficult, and the problem of mercury bridging at these close spacings must be overcome. All the problems known to apply to macro-scale liquid contacts will likely apply to the structure of MEM micro-relay 10. The addition of liquid contacts to this MEM micro-relay design thus requires the use of a different construction technique and different contact systems.

A vertical structure MEM relay using electrostatic actuators can be fabricated with multiple anchor points and both contact springs and release springs as an alternative to the cantilever described in FIG. 1. An example of an radio frequency (RF) relay having contact and release springs is described in *Micro Machined Relay for High Frequency Application,* Komura et al., OMRON Corporation $47^{th}$ Annual International Relay Conference (Apr. 19–21, 1999) Newport Beach, Calif., Page 12-1, and Japanese Patent Abstract, Publication number 11-134998, publication date May 21, 1999.

FIG. 2 shows a conventional MEM switch with a lateral actuator. The micro-relay 10' has a substrate 32 supporting a lateral actuator 70 connected to a shorting bar support 44. A first conductive control contact 60*a*' is mounted in the housing substrate 32 and a second conductive control contact 60*b'* is mounted in the substrate 32. A shorting bar 52' is disposed on the shorting bar support 44. A first signal contact 50' and a second signal contact 54' are disposed on the same housing substrate 30. The shorting bar 52' places signal contacts 50' and 54' into electrical contact when the mirco-relay 10' is in a closed position.

Applying liquid contacts to this conventional micro-relay structure is also difficult for the reasons described above. The typical physical separation between the contacts on the substrate and the shorting bar is a few micrometers. This makes it difficult to insert liquid metal (e.g. mercury) on the contacts after the MEM switch is fabricated.

There is a need in the art for further improvements in MEM relays eliminating the shortcomings of the existing technology. What is needed is a long life, high current, and high voltage contact structure combined with a MEM actuator to form a direct current (DC) or RF micro-relay fabricated using micro-electromechanical (MEM) processes. In some applications there is a need to use liquid metal contacts which do not include mercury because of environmental considerations.

SUMMARY OF THE INVENTION

It would be desirable to fabricate contact structures capable of withstanding several hundred volts open circuit and amperes of current closed circuit and having an operating life of at least one billion operations. For many applications, there is a need to improve the contacts of a MEM relay with the use of liquid metal. Where mercury can be used, it is possible to separately fabricate a contact substrate containing liquid metal contacts and bond the contact substrate to an actuator substrate to form a MEM relay.

Liquid metal is not restricted to mercury, as many metals and conductive alloys will liquefy at usable temperatures relative to the rest of the MEM structure. Although the physical size of conventional relays makes the concept of heating the contacts or the whole relay impractical, the microscopic nature of MEM microrelay contacts as compared to conventional relay contacts makes it feasible to heat the contact region (or the whole MEM microrelay) in order to obtain a liquid contact operation.

The need in the art is addressed by the MEM design and method of the present invention. In accordance with the inventive teachings, A MEM relay includes an actuator, a shorting bar disposed on the actuator, a contact substrate, and a plurality of liquid metal contacts disposed on the contact substrate such that the plurality of liquid metal contacts are placed in electrical communication when the MEM relay is in a closed state. Further, the MEM relay includes a heater disposed on said contact substrate wherein said heater is in thermal communication with the plurality of liquid metal contacts. The contact substrate can additionally include a plurality of wettable metal contacts disposed on the contact substrate wherein each of the plurality of wettable metal contacts is proximate to each of the plurality of liquid metal contacts and each of the wettable metal contact is in electrical communication with each of the plurality of liquid metal contacts.

With such an arrangement the contact system can utilize contact materials compatible with MEM fabrication techniques which can be liquefied using a heater while the relay is operating at normal temperatures. The wettable metal contacts and the liquid metal contacts provide a long life, high current, and high voltage contacts for MEM relays. Additionally in certain application, the use of mercury can be avoided.

In a further aspect of the invention, a MEM relay includes an actuator, a non-wetting metal shorting bar disposed on the actuator, and a contact substrate, having an upper surface and a lower surface, in a spaced apart relationship with the non-wetting metal shorting bar. The MEM relay further includes a first liquid metal contact disposed on the upper surface of the contact substrate with a first signal contact disposed on the lower surface of the contact substrate, and a first via having an outside surface and an interior surface coated with liquid metal, passing through the contact substrate, and placing the first liquid metal contact and the first signal contact in electrical communication when the MEM relay is in a closed state. Finally the MEM relay includes a second liquid metal contact disposed on said upper surface of the contact substrate with second signal contact disposed on the lower surface of the contact substrate, and a second via having an outside surface and an interior surface coated with liquid metal, passing through said contact substrate, and placing said second liquid metal contact and said second signal contact in electrical communication when the MEM relay is in a closed state.

With such an arrangement inserting liquid metal contacts into a MEM micro-relay can be is accomplished by taking advantage of the capillary flow of liquid metals and inserting the liquid metal after the micro-relay is fully fabricated. This method allows a MEM contact structure to be co-fabricated with the MEM actuator.

In accordance with another aspect of the present invention, a method of fabricating a MEM relay includes the steps of providing a actuator, providing a non-wetting metal shorting bar disposed on the actuator, providing a contact substrate, having an upper surface and a lower surface, in a spaced apart relationship with the non-wetting metal shorting bar, and providing a first liquid metal contact disposed on the upper surface of the contact substrate. The method further includes providing a first signal contact disposed on the lower surface of the contact substrate, providing a first via having an outside surface and an interior surface coated with liquid metal, passing through the contact substrate, and placing the first liquid metal contact and the first signal contact in electrical communication when the MEM relay is in a closed state, providing a second liquid metal contact disposed on the upper surface of the contact substrate. Finally the method includes providing a second signal contact disposed on the lower surface of the contact substrate, and providing a second via having an outside surface and interior coated with liquid metal, passing through the contact substrate, and placing the second liquid metal contact and the second signal contact in electrical communication when the MEM relay is in a closed state, and introducing liquid metal through the first and second vias to wet the first and second contacts.

With such a fabrication technique, the liquid metal contacts can receive liquid metal from an external source supplied through the vias. In addition a larger quantity of liquid metal can form liquid metal contacts which can form a physical electrical connection without a requirement for a conductive metal shorting bar. The contacts fabricated with the inventive technique have a longer life, can carry higher currents, and can handle higher voltage signals than typical contacts used in MEM relays.

In accordance with yet another aspect of the present invention, a MEM relay includes a separately fabricated contact substrate having at least two liquid metal contacts. The control substrate is bonded to an actuator substrate. With such an arrangement the contact system is fabricated separately from the actuation system, and then the two assemblies are bonded together allowing the use of liquid metal inserted on wettable metal contact surfaces or the use of liquid metal contacts which can be placed in electrical and mechanical contact. The liquid metal wetted metal contacts and the liquid metal contacts provide a long life, high current, and high voltage contacts for MEM relays.

Although the inventive teachings are disclosed with respect to an electrical application, the present teachings may he used for other MEM relay structures and other applications as will be appreciated by those skilled in the art.

These and other objects, aspects, features and advantages of the invention will become more apparent from the following drawings, detailed description and claims.

BRIEF DESCRIPTION OF THE DRAWINGS

The foregoing features of this invention, as well as the invention itself, may be more fully understood from the following description of the drawings in which.

DETAILED DESCRIPTION OF THE INVENTION

Before proceeding with a detailed discussion of the instant invention, some introductory concepts and terminology are explained. The term "liquid metal contact" refers to an electric contact whose mating surface during the conduction of electric current consists of a molten metal or molten metal alloy. The liquid metal contact (molten metal) will be retained (held in place) by a solid (non-molten) structure. The solid structure may be wettable so that it will retain a layer of a liquid metal, for example mercury. The term "liquid metal contact" can also refer to a quantity of liquid metal which forms a structure, for example a droplet, which is held in place by surface tension on a metal surface of a MEM device or a retaining structure to control the position of the liquid metal. The terms switch and relay are used interchangeably.

MEM devices are typically built using substrates compatible with current integrated circuit fabrication, although some of the electronic switch or relay structures disclosed herein do not require such a substrate for a successful implementation. The electronic contact substrate must have properties (dielectric losses, voltage withstanding, etc.) compatible with the desired switch performance and amenable to an interface with the electronic actuator structure if the actuator and switch portions are fabricated separately.

Conventional metal contacts on MEM devices have a limited operating life. Liquid metal contacts can improve the operating life of the contact system. However, applying liquid contacts to conventional micro-relay structures is difficult. For example, the typical physical separation between the contacts on the substrate and cantilever actuator is a few micrometers. This separation makes it difficult to insert mercury on the contacts after the MEM switch is fully operational. The use of a wide spacing on the cantilever (requiring a tall cantilever support) would increase the control voltage required for operation.

Figure 3:
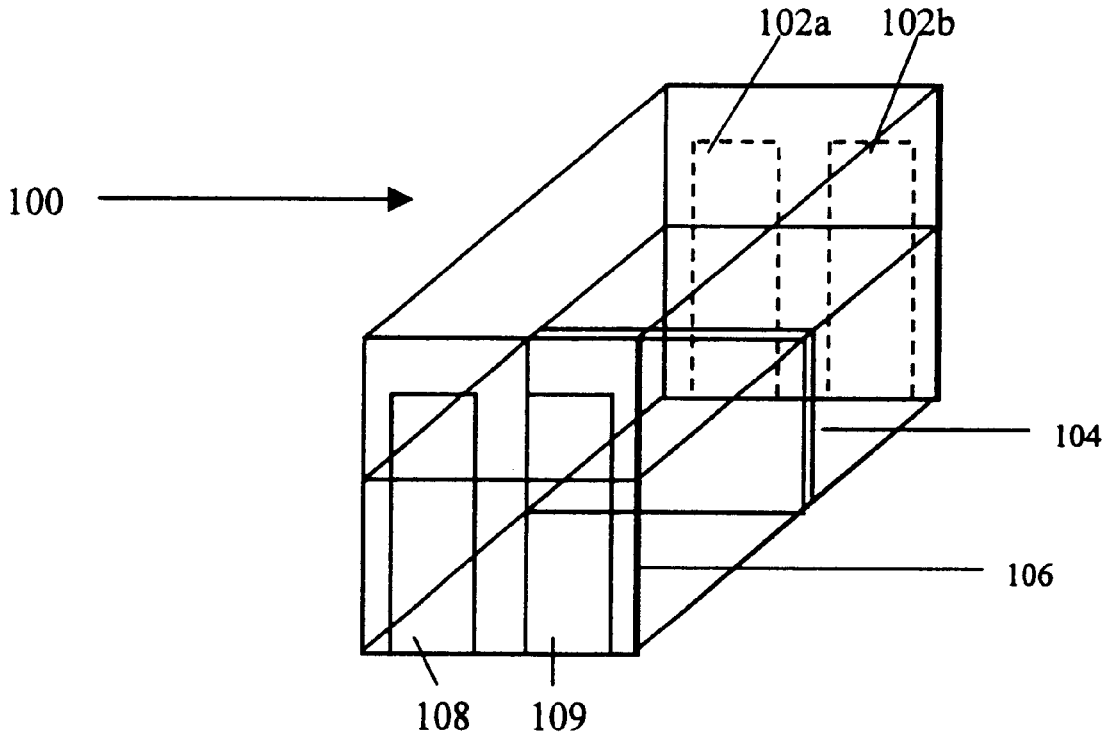
FIG. 3 is a schematic diagram of an integrated actuation substrate and contact substrate having liquid metal forming a micro-relay according to the present invention.

Referring now to FIG. 3, a high performance MEM relay 100 is shown as an integrated package. FIG. 3 shows the general construction integrated packaging for the MEM relay 100 relay without the details of the actuator or contact mechanism. The MEM relay 100 includes an actuator substrate 104 bonded signal contact substrate 106 (also referred to as an contact region) to form the modular relay 100. The final package (not shown) is likely to be a few millimeters on a side (as required to separate an individual die from the full substrate by mechanical sawing), with current fabrication techniques for printed wiring boards and hybrid modules dictating the required spacing between the two signal contacts 108 and 109 and the two control contacts 102*a* and 102*b*.

The MEM relay 100 is arranged to provide a self-packaging micro-relay. The addition of a top and bottom cover (not shown) to the MEM relay 100 makes a complete self-packaging assembly. The placement of external connections signal contacts 108 and 109 and control contacts 102*a* and 102*b* on the exterior of the substrates permits the full assembly to be used as a surface mount component. The MEM relay 100 may also be used as part of a higher level assembly (such as a hybrid module). Fully integrated construction eliminates the need for a separate large package or internal bonding wires associated with conventional packaging techniques.

Figure 3A:
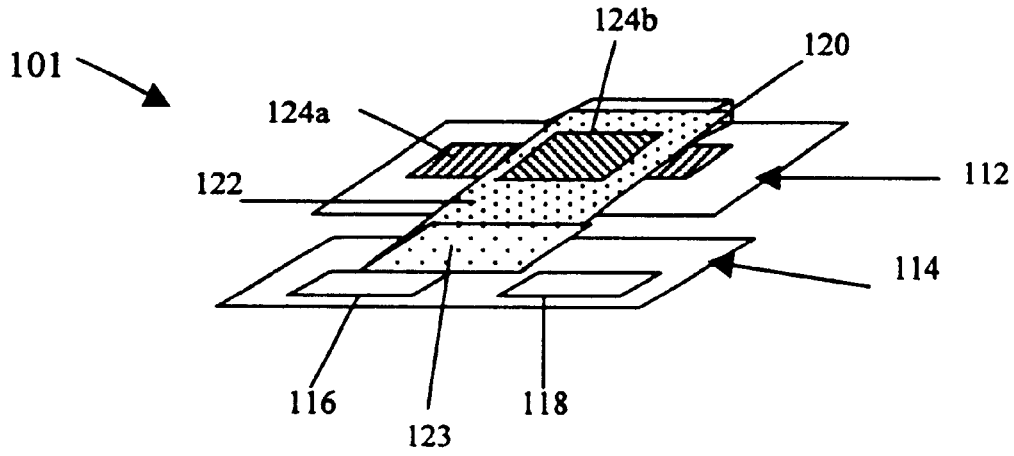
FIG. 3A is a schematic diagram of a vertical MEM device with an integrated actuation substrate and contact substrate having liquid metal contacts according to the present invention.

Referring now to FIG. 3A, an alternate embodiment based on separate actuator and contact substrates, here a vertical MEM relay 101 is shown. The vertical MEM relay 101 includes an actuator substrate 112 that is assembled with a contact substrate 114 after each substrate is separately fabricated.

The actuator substrate 112 includes a machined cantilever support 120 and a first actuator control contact 124*a*. One end of a cantilever 122 is disposed on cantilever support 120 and includes a second actuator control contact 124*b*. The other end of the cantilever 122 includes a shorting bar 123. The two conductive actuator control contacts 124*a* and 124*b* control the actuation of the vertical MEM relay 101.

Liquid metal signal contacts 116 and 118 are fabricated on the separate contact substrate 114. The addition of liquid contacts to vertically activated MEM switches requires that the contact substrate 114 be separately fabricated from the actuator substrate 112. The liquid signal contacts 116 and 118 preferably have a liquid metal conductive surface using mercury. A separate fabrication process for the liquid metal signal contacts 116 and 118 allows the quantity of liquid metal on the contact structure to be carefully controlled. The contact substrate 114 is assembled with the actuator substrate 112 after the liquid metal is applied. It should be appreciated that additional layers can be fabricated between the liquid metal signal contacts 116 and 118 and the contact substrate 114 for example a wettable metal contact and an insulating layer.

In operation, with no control signal applied, the vertical MEM relay 101 is in an open position. In this position, the shorting bar 123 on the cantilever 122 is raised above the actuator substrate 112 by the support 120 and is also raised above the contact substrate 114. The first and second liquid metal signal contacts 116 and 118 on the contact substrate 114 are not connected. An electrostatic force created by a potential difference between the second actuator control contact 124*b* and the first actuator control contact 124*a* on the actuator substrate 112 is used to pull the cantilever 122 down to toward the actuator substrate 112. It is also used to pull the cantilever 122 down to the separately fabricated contact substrate 114 which is bonded to the actuator substrate 112.

The vertical MEM relay 101 uses the conductive shorting bar 123 to make a connection between the two signal contacts 116 and 118 attached to the separate contact substrate 114. When pulled to the separate contact substrate 114, the shorting bar 123 touches liquid metal surfaces of the first and second liquid metal signal contacts 116 and 118 and electrically connects them together. The cantilever 122 typically has an insulated section (not shown) separating the shorting bar 123 from the cantilever electrostatic control contact 124*b*. Thus, the first and second liquid metal signal contacts 116 and 118 are connected by the shorting bar 123 of cantilever 122, which is operated by an isolated electrostatic force mechanism using the surfaces of the two actuator control contacts 124*a* and 124*b*.

The vertical MEM relay 101 is shown as a normally open (NO) switch contact structure. The open gap between the conductive control contact 124*a* and the cantilever 122 beam is typically a few microns ($1/1{,}000{,}000$ meter) wide. When the vertical MEM relay 101 is in the closed position, the cantilever beam 122 is proximate to the conductive actuator control contact 124*a*. However, the control surfaces, actuator control contacts 124*a* and 124*b*, cannot be in direct electrical contact or the control signal will be shorted. Since the actuator substrate 112 is separately fabricated from the contact substrate 114, the liquid metal applied to the first and second liquid metal signal contacts 116 and 118 does not interfere with the conductive actuator control contact 124*a* and the cantilever beam 122 operation.

In operation, the contact substrate 114 is precision aligned with the cantilever beam 122 and the actuator substrate 112, allowing the cantilever beam 122 and shorting bar 123 to be drawn down to the contact subsystem including liquid metal signal contacts 116 and 118 fabricated on the separate contact substrate 114 and containing liquid metal. The weak forces created by a vertical electrostatic control system for the cantilever beam actuator are an additional problem. Such weak forces limit the travel available for the cantilever beam, and any wetting of the cantilever beam by the liquid contact material may create enough surface tension that the cantilever beam may be unable to draw away from the contacts. This results in a failed (shorted) micro-relay system. To abate this problem, the shorting bar 123 is preferably non-wetting.

It should be appreciated that a vertical structure MEM relay using electrostatic actuators can be fabricated with multiple anchor points and both contact springs and release springs as an alternative to the cantilever beam 122. Such a multi-layer vertical structure is amenable to the use of liquid contacts, since the contact substrate is separately fabricated from the movable actuator substrate.

Separate fabrication of the actuator and the switch structures is not required where mercury is not being used as the liquid contact material and a method and structure (for example a heater (not shown) disposed on the contact substrate) can be provided to prevent the liquid contact material from solidifying at operational temperatures.

Figure 1:
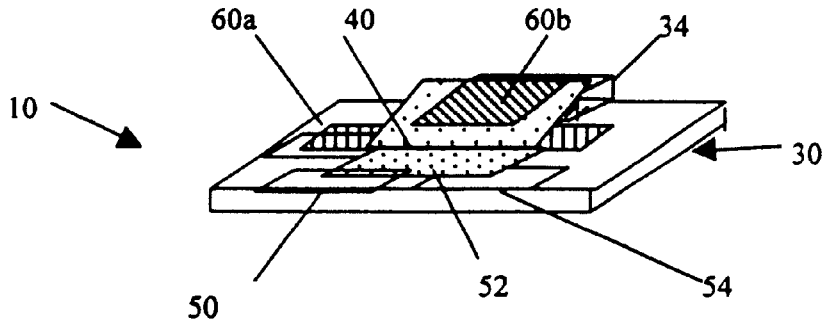
FIG. 1 (Prior Art)
FIG. 1 is a diagram of a conventional prior art vertically activated surface micromachined electrostatic MEM micro-relay.
Figure 4:
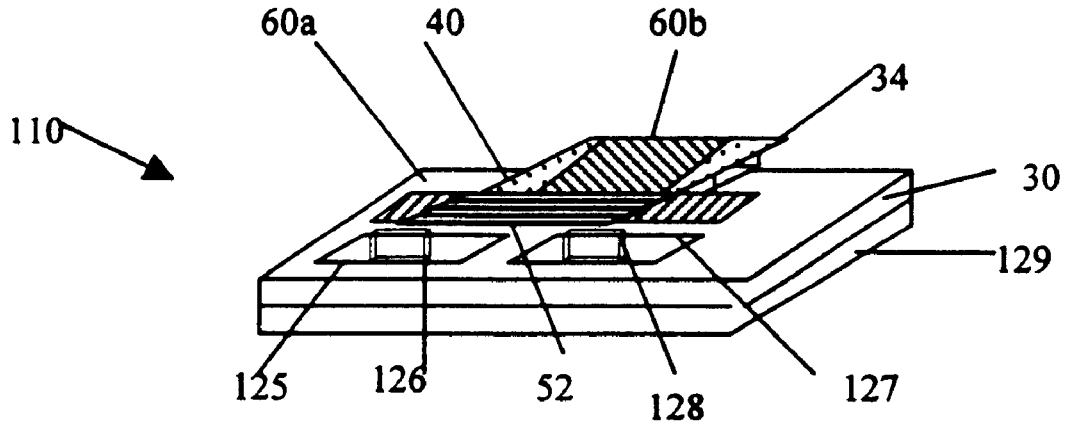
FIG. 4 is a schematic diagram of a vertical MEM device with liquid metal contacts and a heater according to the present invention.

Referring now to FIG. 4, an alternate embodiment of FIG. 1, here a simplified vertical MEM relay 110 is shown. The vertical MEM relay 110 includes some of the elements of FIG. 1. (like elements of the relay of FIG. 1 are provided having like reference designations) and additionally includes heater 129 disposed on contact substrate 30. In a preferred embodiment, wettable metal contacts 125 and 127 are fabricated on contact substrate 30 using nickel (Ni). Liquid metal contacts 126 and 128 are disposed on wettable metal contact 125 and 127 respectively. Surface tension has a retention effect on the liquid metal on the contact surfaces. Surface tension also helps control the loss of the liquid metal due to splashing as the contact opens. Preferably, gold (Au) is used for the liquid metal contacts 126 and 128 and can be fabricated using techniques known in the art.

In operation, heater 129 supplies sufficient heat conducted to the liquid metal contacts 126 and 128 to maintain a liquid or nearly liquid contact layer. The heater 129 preferably supplies sufficient heat to cause micromelting at the liquid metal contact 126 and 128 layer without melting the wettable metal contacts 125 and 127. With the exception of mercury, typical contact materials will solidify at normal relay operating temperatures. To obtain the benefits of liquid metal contacts using typical materials, there must be some form of heat source to maintain the molten material state during electric current flow in the microrelay contacts. The heat source may be external or internal. It should be appreciated that an internal heat source may be a separate heater for the contact region proximate to the liquid metal contacts, or it may heat the whole microrelay. The contact region can be heated by the ohmic (Joule) heat generated in the contact material as a result of electric current flow. A combination of heating methods may be simultaneously employed. A thermally controlled actuator can also generate heat. Other heating methods are known in the art and are not specifically discussed here.

The presence of a moderate resistance contact when the contacts close (1 to 10 ohms or so) will hasten the contact heating. If the contacts are torn apart during the opening process by breaking a microweld, the contact surface will probably be very rough. The rough surface may result in moderate contact resistance at closure. Moderate contact resistance at closure will result in rapid heating of the liquid metal contacts 126 and 128, restoring a good contact system through the formation of the liquid metal.

There is reduced damage to the liquid metal contacts 126 and 128 from sliding wear during closing or opening of the MEM relay 110 because the melting action erases any sliding wear at each closure. It should be appreciated that other relay configurations using the contact structure of MEM relay 110 can be combined with electrostatic actuators fabricated with multiple anchor points and both contact springs and release springs as an alternative to the cantilever structure. Various types of contact shapes can be used including but not limited to flat surfaces and mating surfaces such as convex and concave shapes.

Figure 4A:
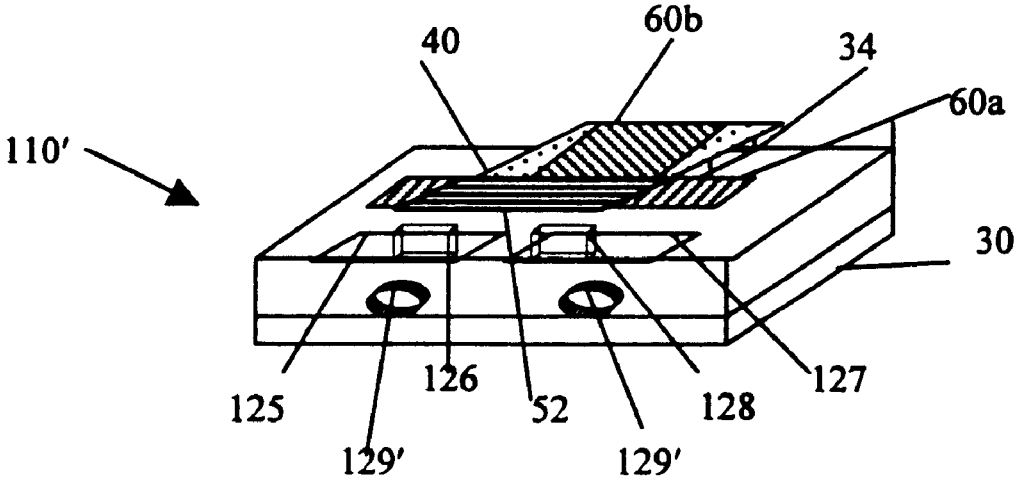
FIG. 4A is a schematic diagram of a vertical MEM device with liquid metal contacts and a heater disposed proximate to the liquid metal contacts according to the present invention.

Referring now to FIG. 4A, an alternate embodiment of FIG. 4, MEM relay 110' includes separate heaters 129' disposed on the contact substrate 30 between the contact substrate 30 and the wettable metal contacts 125 and 127 and proximate to the liquid metal contacts 126 and 128. With this arrangement of heaters 129', heat can be delivered to the liquid metal contacts 126 and 128 more efficiently and with greater control.

Figure 5:
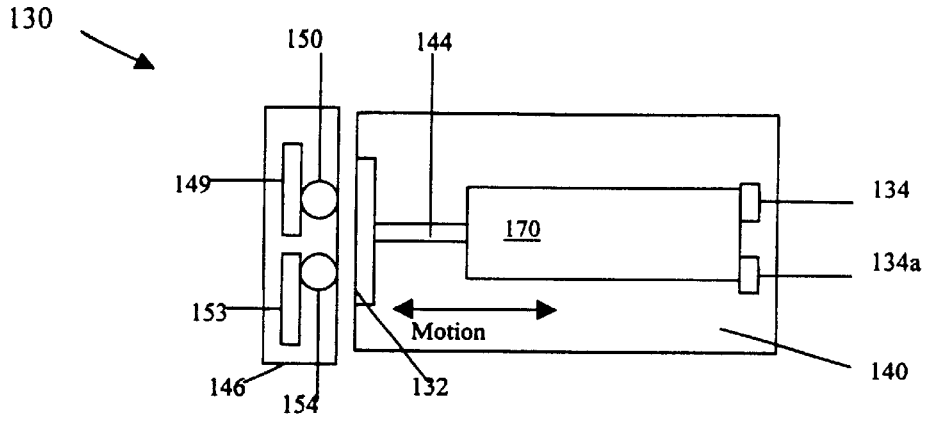
FIG. 5 is top view of a lateral MEM micro-relay substrate capable of utilizing liquid contacts in accordance with the teachings of the present invention.

Referring now to FIG. 5, a lateral MEM relay 130 capable of utilizing liquid contacts is shown. The lateral MEM relay 130 can be manufactured using a separate actuator substrate 140 and a contact substrate 146, which are bonded together after the application of liquid metal to the contacts on the substrate 146 if mercury is used to wet the contacts. Alternatively a heater (not shown) can be used to provide liquid metal contacts without the need for mercury or separate fabrication and bonding.

A lateral MEM actuator 170 is fabricated on the actuator substrate 140. A shorting bar support 144 is connected at one end to the lateral MEM actuator 170 and to a shorting bar 132 on the other end. The lateral MEM actuator 170 can have high contact make and break forces coupled with a significant travel length to make the application of liquid contacts to the lateral structure feasible when bonding the two separately fabricated structures, the actuator substrate 140 and the contact substrate 146. The shorting bar 132 is preferably fabricated as a metal structure and is non-wetting.

A first wettable metal signal contact 149 and a second wettable metal signal contact 153 are fabricated on the contact substrate 146. If the shorting bar 132 was wetted by the liquid metal, the contact break operation would be complicated by the bridging of the liquid metal from wetting surfaces 149 and 153 to the shorting bar 132 as the shorting bar 132 was withdrawn to open the contacts. The shorting bar 132 is preferably non-wetting to avoid this problem.

If a heater (not shown) is not used, liquid metal, preferably mercury is applied to the contacts during fabrication to form the liquid metal contacts 150 and 154. The wettable metal signal contacts 149 and 153 are metal structures (preferably silver if mercury is used) anchored to the contact substrate 146 or as metal attached to the wall of the contact substrate 146. Preferable construction methods include bulk or surface micromachining or deep reactive ion etching.

A liquid metal contact 150 is disposed on the first wettable metal signal contact 149 and liquid metal contact 154 is disposed on the second wettable metal signal contact 153. If a heater (not shown) is used, gold is preferably used for the liquid metal contacts 150 and 154. The wettable metal signal contacts 149 and 153 are preferably nickel structures if gold is used as the liquid metal. It should be appreciated that there are other combinations of wettable metal and liquid metals that can be used to fabricate the contact structure. The wettable metal signal contacts 149 and 153 can be insulated from the contact substrate 146 by additional insulating layers (not shown). The insulation layer is sometimes necessary because some substrates are partially conductive. An insulating substrate would not need an insulating layer if the wettable metal contacts would adhere to the insulating substrate.

In operation, the actuator operates to move the shorting bar 132 toward the first liquid metal contact 150 and the second liquid metal contact 154. When the shorting bar 132 contacts the liquid metal surface of the liquid metal contacts 150 and 154, both the liquid metal contacts 150 and 154 and the wettable metal signal contacts 149 and 153 are electrically connected.

Returning the shorting bar 132 to the state shown in FIG. 5 opens the liquid metal contacts 150 and 154 and the wettable metal signal contacts 149 and 153. The shorting bar 132 is preferably non-wetting so the contact can be more efficiently broken. If the liquid metal contacts 150 and 154 were to wet the shorting bar 132, when the liquid metal contacts 150 and 154 were opened the liquid metal would adhere to the shorting bar 132 and be drawn into the gap region by liquid surface tension of the liquid metal. This could prevent the contacts from opening. To abate this problem, the shorting bar 132 is preferably non-wetting.

Figure 2:
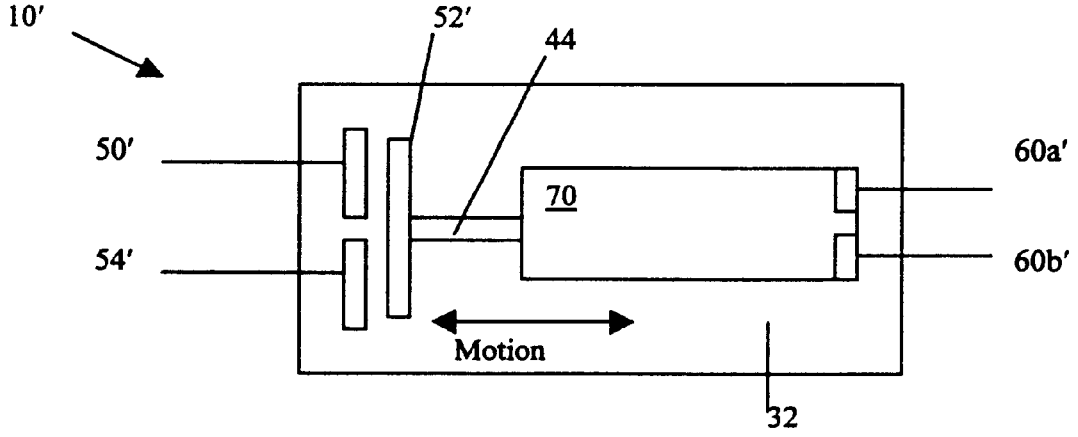
FIG. 2 (Prior Art)
FIG. 2 is a top view of a conventional prior art lateral MEM micro-relay.

When assembled, the lateral MEM relay 130 operates similarly to the conventional lateral actuation micro-relay previously discussed in conjunction with FIG. 2. However, the use of the liquid contact surfaces made possible by the separate contact structure 146 having liquid metal contacts 150 and 154 at operational temperatures or by the use of heated liquid metal contacts at lower temperatures, allows a large current carrying cross section having a very low resistance. Careful construction permits the lateral MEM relay 130 to be useful with signals at extremely high frequencies by controlling parasitic inductance and capacitance. The ability to handle high currents is a function of the losses in the contact structure resulting in heating of the liquid metal to the vaporization point. Excessive heating can be controlled by providing a low thermal resistance (and a large thermal mass) to the heat generated at the liquid contacts. In an alternate embodiment operating at low temperatures, the lateral MEM relay 130 can include a heater structure (not shown) near the liquid metal of the liquid metal contacts 150 and 154 to keep them from solidifying. A heating structure that uses positive temperature coefficient resistive materials would not necessarily require a separate temperature sensor. As the positive temperature coefficient material is heated, the increased resistance will reduce the heat generated and stabilize the contact temperature. The ohmic losses of the liquid metal contact system will also supply heat and tend to keep the contacts in the liquid state when carrying electric current.

It should be appreciated that the lateral MEM relay 130 may use any of a number of techniques to achieve actuator motion. Examples include electrostatic comb actuators, magnetic actuators, piezoelectric actuators, and thermal actuators.

Figure 6:
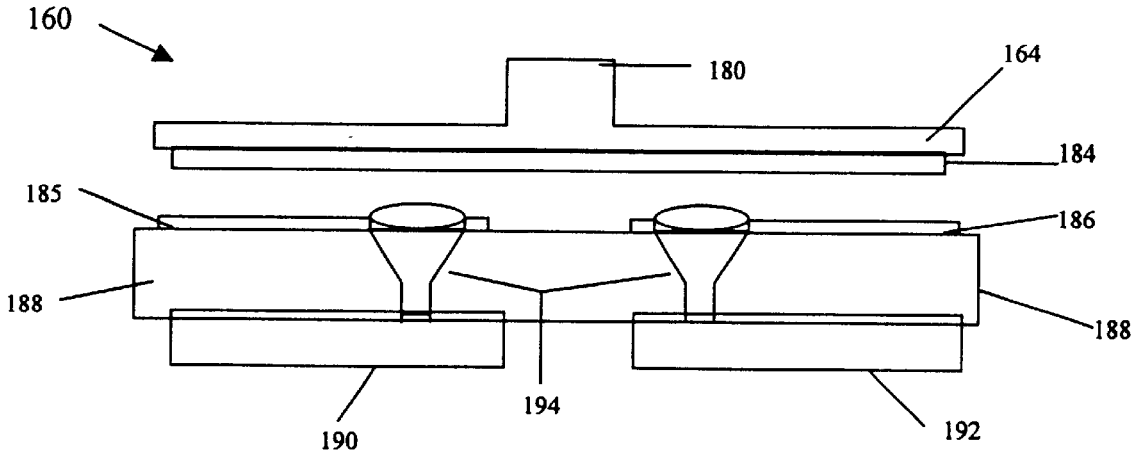
FIG. 6 is a top view of the contact region of a lateral MEM micro-relay having liquid metal filled contacts according to the present invention.

Referring now to FIG. 6, a contact region of a lateral MEM relay 160 fabricated using an alternative liquid contact filling technique is shown. The entire contact system is not shown. FIG. 6 shows an alternate structure for shorting bar 132 (FIG. 5) and liquid metal contacts 150 and 154 of MEM relay 130 (FIG. 5). The MEM relay 160 does not require the bonding of a separate actuator substrate and a separate contact substrate. The lateral MEM relay 160 contact structure includes a shorting bar 184 disposed on actuator 180. The shorting bar 184 is preferably fabricated having a non-wetting metal surface. A contact substrate 188 includes two liquid metal contacts 185 and 186 on a surface of the contact substrate 188 spaced apart from and facing the non-wetting metal shorting bar 184. Preferably, the interior surface of the substrate wall has contact surfaces which are treated to have two wetting areas (not shown) for liquid metal contacts in order to retain the liquid metals. The liquid metal contacts 185 and 186 are vertical metalizations at two locations on a surface of the contact substrate 188. Each liquid metal signal contact 185 and 186 has an electrically conducting via 194 connecting it to the outside edge of the contact substrate 188. Two external signal contacts 190 and 192 are disposed on outside edge of the contact substrate 188.

The via 194 is an aperture micromachined in the substrate. The via 194 is an access path from one side of the substrate through the substrate to the opposite side. After micromachining, the via 194 may be lined with metal that is wettable with the liquid contact metal to form a metal surface through the substrate. The via 194 is placed in the contact substrate 188 after dicing of the wafer holding the individual MEM devices. The via 194 area is wettable to allow capillary flow to fill the contact region with liquid metal filled from an external liquid metal source though the vias 194.

Following assembly, the liquid metal is applied to the outside surface at the via 194, and capillary action draws the liquid metal into the interior. The surface tension and capillary action result in the coating of the two contact areas with liquid metal. The external access to the vias 194 is then sealed, and the two external signal contacts 190 and 192 are placed on the exterior of the contact substrate 188.

In operation, the metal shorting bar 184 is preferably non-wetting with the liquid metal contacts 185 and 186 to avoid bridging of the contacts when the lateral MEM relay 160 is open. When the MEM relay 160 is closed, metal shorting bar 184 contacts both liquid metal signal contacts 185 and 186 and electrically connects the two external signal contacts 190 and 192 through electrically conducting vias 194. A wetting of the metal shorting bar 184 would require that the contact-to-shorting bar spacing exceeds the liquid metal surface tension bridging distance when the lateral MEM relay 160 is open.

The inventive structure allows for the application of a liquid metal to the liquid metal contacts 185 and 186, following the fabrication of the MEM actuator 180 and MEM contact metalization. The use of capillary action is used to replenish the liquid metal on the liquid metal contacts 185 and 186.

The metal shorting bar 184 can be fabricated with a non-wetting conductive surface that is in contact with the liquid metal surface of the liquid metal contacts 185 and 186. Any significant wetting of the metal shorting 184 bar may result in the formation of a liquid bridge from the liquid metal contacts 185 and 186 to the metal shorting bar 184, and the resultant failure of the liquid metal contacts 185 and 186 to open when the actuator 180 is retracted. The contact material on the liquid metal contacts 185 and 186 must be wettable to retain the liquid metal.

If an optional wettable shorting bar (not shown) is used, it must be able to retract from the liquid metal contact area to the point that the surface tension of the liquid metal will break any bridging short circuits.

There is preferably a defined quantity of liquid metal on each wettable contact surface. A heating device (not shown) can be bonded to the contact substrate 188 if required to maintain the liquid metals used for the contacts in a liquid state at low operating temperatures. For example, the heater would keep mercury from solidifying at temperatures below minus 37 degrees centigrade. The heater is a positive temperature coefficient resistor, such that the heating power and liquid metal temperature are somewhat self-regulating. The heater may also be an external device to which one or more micro-relays are in thermal contact.

A top cover (not shown) and a bottom cover (not shown) can be bonded to the MEM relay 160 to form a sealed package on all sides, with the external signal contacts 190 and 192 and control connections (not shown) available on the outside surface of the MEM relay 160 to form a structure such as shown in FIG. 3.

The contact structure occupies the full vertical dimension of the contact substrate wall. Additionally, there are side walls (not shown) that enclose the contact region with only a small clearance at the side wall for the actuator 180, such that the contact region around contact substrate 188 is effectively sealed and will minimize the splashing problem. The seal results from the surface tension of the liquid metal against the non-wetting surfaces of the substrate walls. Only the wall with the contacts is shown in FIG. 6. The complete structure is similar to the packaging arrangement as shown in conjunction with FIGS. 3 and 5.

Figure 7:
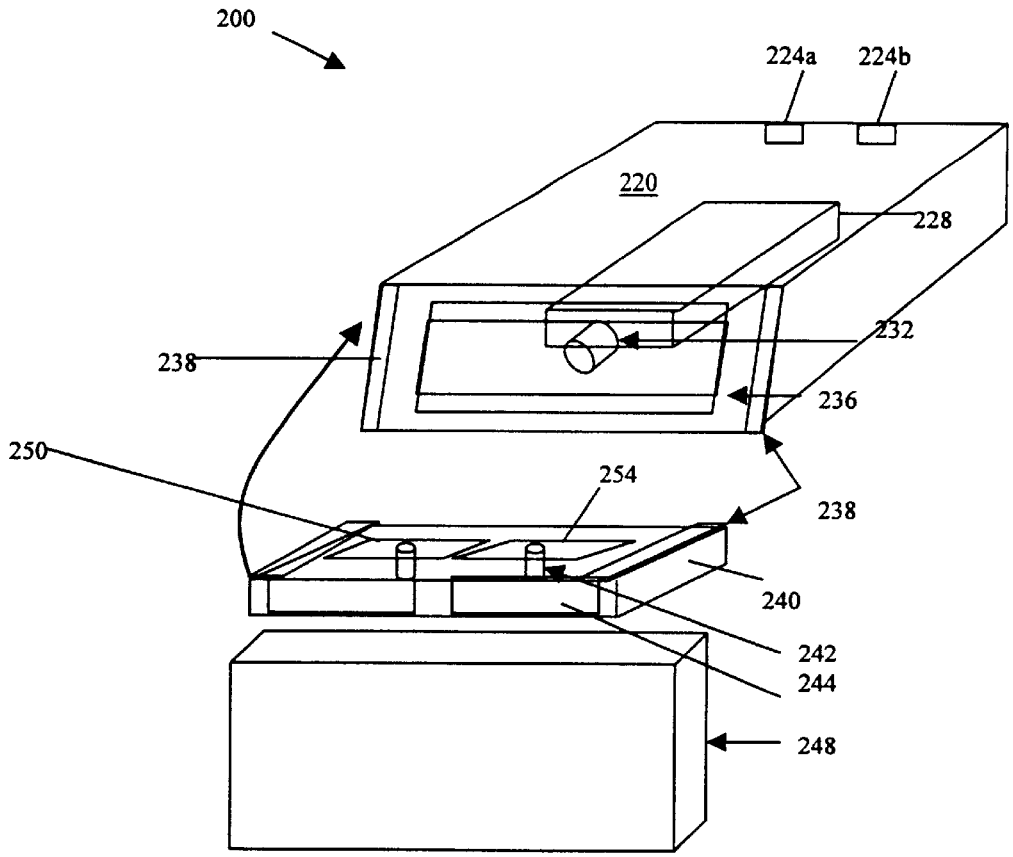
FIG. 7 is a schematic diagram illustrating integrating a lateral actuator with a separately fabricated set of liquid metal contacts to form a MEM micro-relay according to the present invention.

Referring now to FIG. 7, a MEM relay 200 includes a lateral actuator 228 fabricated on an actuator substrate 220 and a separately fabricated contact substrate 240. The contact substrate 240 includes liquid metal contacts 250 and 254 and external connections 244. The contact substrate 240 also includes external signal contacts 244 connected to liquid metal contacts 250 and 254 through vias 242. This structure is similar to the packaging arrangement shown in conjunction with FIG. 3.

The lateral actuator 228 is typically fabricated in a well in the middle of the actuator substrate 220, and is supported by the actuator substrate 220. The lateral actuator 228 motion is with respect to actuator fabrication substrate 220. The actuator 228 is typically able to produce force in either direction of motion (toward or away from the liquid metal contacts 250 and 254). The actuator fabrication substrate 220 has external actuator control contacts 224*a* and 224*b* for coupling a signal to control the actuator. Making these external actuator control contacts 224*a* and 224*b* for the actuator control available on the outside surface of the actuator fabrication substrate 220 enables the fabrication of a unified self-packaging MEM relay described above in conjunction with FIG. 3.

An insulated actuator spacer 232 is connected between the lateral actuator 228 and a shorting bar 236. The purpose of the insulated actuator spacer 232 is to insure the isolation of the signal path from the actuator control path. The isolation of the signal path from the control path is not a requirement for the use of liquid metal contacts, but is commonly a requirement for useful applications of a microrelay.

The liquid metal contacts 250 and 254 and the shorting bar 236 are both preferably essentially flat surfaces. It should be appreciated that other contact surface options are possible. The MEM relay 200 is assembled by bonding the actuator substrate 220 and the separately fabricated contact substrate 240 at bonding points 238. The MEM relay 200 can include a heater 248 disposed on contact substrate 240 near the liquid metal the signal contacts 250 and 254 to keep them from solidifying. If mercury is not used as the liquid metal, separate fabrication and bonding of the actuator substrate 220 and the contact substrate 240 is not required. The use of vias 242 is not required if the liquid metal contacts 250 and 254 are electrically connected to the external connections 244 through the use of an additional metal path (not shown).

Figure 8:
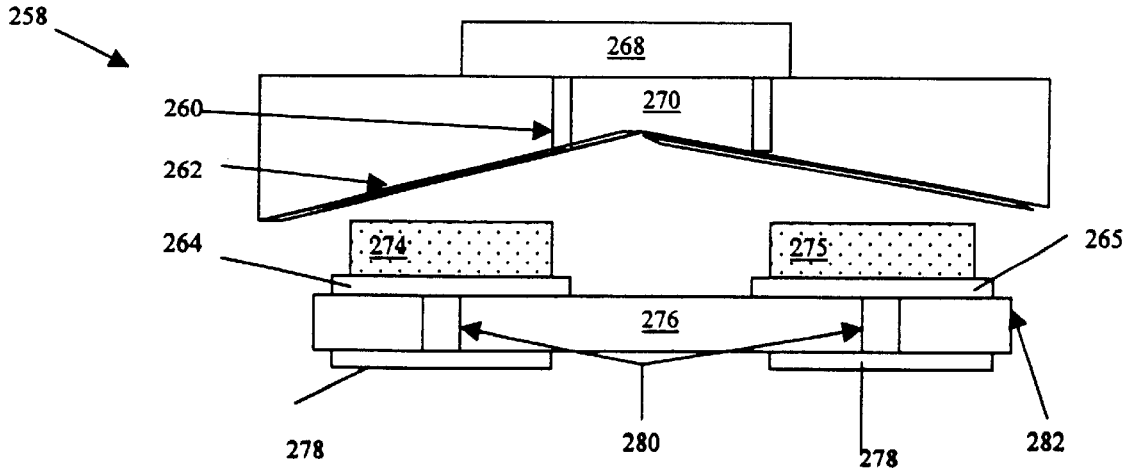
FIG. 8 is a top view of the contact substrate and the shorting bar of a liquid metal contact filled lateral MEM micro-relay substrate in the open position in an alternative embodiment of the present invention.

Referring now to FIG. 8, an alternate MEM relay 258 has a shorting bar 262 and contact structure 276 configuration using liquid contacts. The contact substrate 276 includes wettable metal contacts 264 and 265. The wettable metal contacts 264 and 265 connect to external signal contacts 278 through vias 280. Liquid metal contacts 274 and 275 are disposed on the wettable metal contacts 264 and 265. The actuator (not shown) is connected to an actuator insulating spacer 268.

The insulating spacer 268 can be connected to a second shorting bar (not shown) and at both ends and contact assemblies at both ends (only one end is shown in FIG. 7) will allow the fabrication of a MEM relay 258 with dual and opposing contact sets, so the MEM relay 258 can have one or the other set of contacts always closed, but not both at once. This allows the construction of a single pole double throw switch for the MEM relay 258 (sometimes referred to as Form C in current relay terminology). The use of an actuator with a three position capability (active left, rest center, active right) will permit an alternative MEM relay configuration to be developed, providing none, or one of the two contact sets to be activated.

The shorting bar 262 now has a conic depression or a vee-shaped depression on the metalized side, and gas vents 260 to allow trapped gas to escape from the region between the shorting bar 262 and the liquid metal contacts 274 and 275. Gas vents 260 are not needed if the gas pressure does not need to be equalized, or if the switching speed does not need to be maximized. The vee-shaped structure shorting bar 262 includes open ends that allow the gas to escape. The liquid metal is prevented from escaping through the gas venting mechanism. The gas vent 260 are small enough to allow trapped gas to be vented, but not large enough to allow internal pressure on the liquid metal to overcome the surface tension of the liquid metal and force liquid metal through the gas vents 290.

In one embodiment a slight excess of liquid metal is placed on the contacts, and the shorting bar 262 forces the liquid of liquid metal contact 274 to touch the liquid of the liquid metal contact 275. FIG. 8 shows MEM relay 258 with the contacts open, and FIG. 9 shows MEM relay 258 with the contacts closed.

Figure 9:
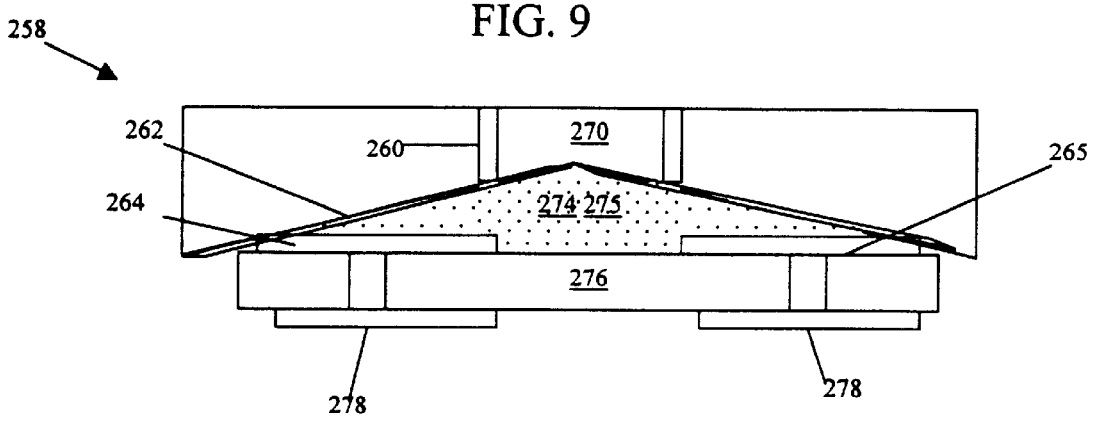
FIG. 9 is a top view of the contact substrate and the shorting bar of a liquid metal contact filled lateral MEM micro-relay substrate in the closed position in an alternative embodiment of the present invention.

Now referring to FIG. 9, the MEM relay 258 of FIG. 8 is shown in a closed position. When the shorting bar 262 moves toward and contacts the liquid metal contacts 274 and 275, the signal circuit, including external signal contacts 278 connected through vias 280, is closed. When the actuator (not shown) moves the shorting bar 262 toward the contacts, the liquid metal contacts 274 and 275 are partially displaced and moved toward the region between the liquid contacts 274 and 275. When enough contact liquid is moved into the volume between the liquid metal contacts 274 and 275, the contact liquid forms an additional current path between the wettable metal contacts 264 and 265 in shunt with the non-wetting shorting bar metal 262. This contact structure provides two paths for electrically connecting external signal contacts 278 together, one from liquid metal contact 274 through the shorting bar 262 to liquid metal contact 275, and the second directly through liquid metal contact 274 in direct physical contact with liquid metal contact 275.

Figure 10:
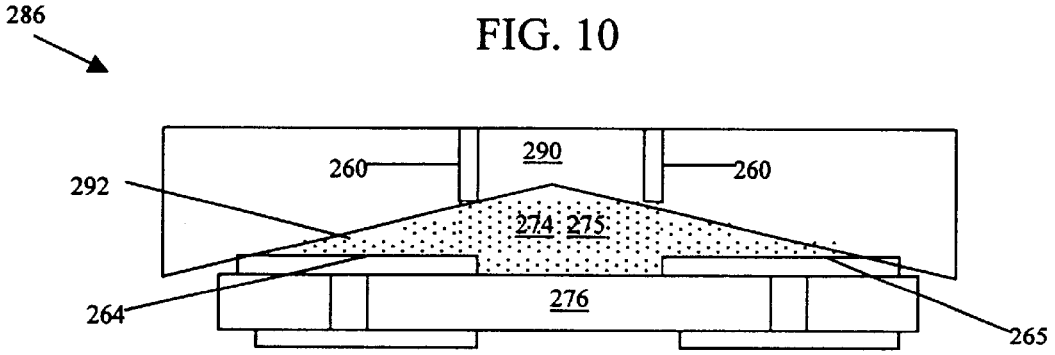
FIG. 10 is a top view of the contact substrate and the non-conductive liquid motion bar of a liquid metal contact filled lateral MEM micro-relay substrate in the closed position in an alternative embodiment of the present invention.

Now referring to FIG. 10, a MEM relay 286, an alternative embodiment of MEM relay 258, has sufficient liquid metal in the liquid metal contacts 274 and 275, so that the non-wetting metal shorting bar can be eliminated and the contact process is completely within the liquid metal making which makes the contact. A conic or vee shape liquid motion bar 292 without a conducting metal layer is disposed on actuator substrate 290. The liquid motion bar 292 is a non-conductive mechanical structure used to force the two liquid metal structures 274 and 275 of FIG. 8 to combine into one conductive structure as shown.

In operation the conic or vee shape liquid motion bar 292 disposed on actuator substrate 290 pushes the liquid metal contacts 274 and 275 together and controls the splashing of the liquid as the liquid motion bar 292 is moved into the liquid. When the liquid metal contacts 274 and 275 are mechanically pushed together they are in electrical contact. If the liquid is forced to splash inward, there is no liquid loss from the contact area and the operating life of the MEM relay 286 is extended. The gas vents 260 must be small enough to prevent the escape of the contact liquid. The surface tension of the contact liquid is a significant factor in controlling liquid escape through the vents.

The actuator (not shown) has a retraction force capability as well as the ability to push the liquid motion bar 292 into the liquid metal. Thus, the actuator participates in both closing the signal path between the contacts and opening the signal path between the contacts.

MEM relay 286 can include a heater (not shown) disposed on contact substrate 276 near the liquid metal signal contacts 274 and 275 to keep them from solidifying.

Figure 11:
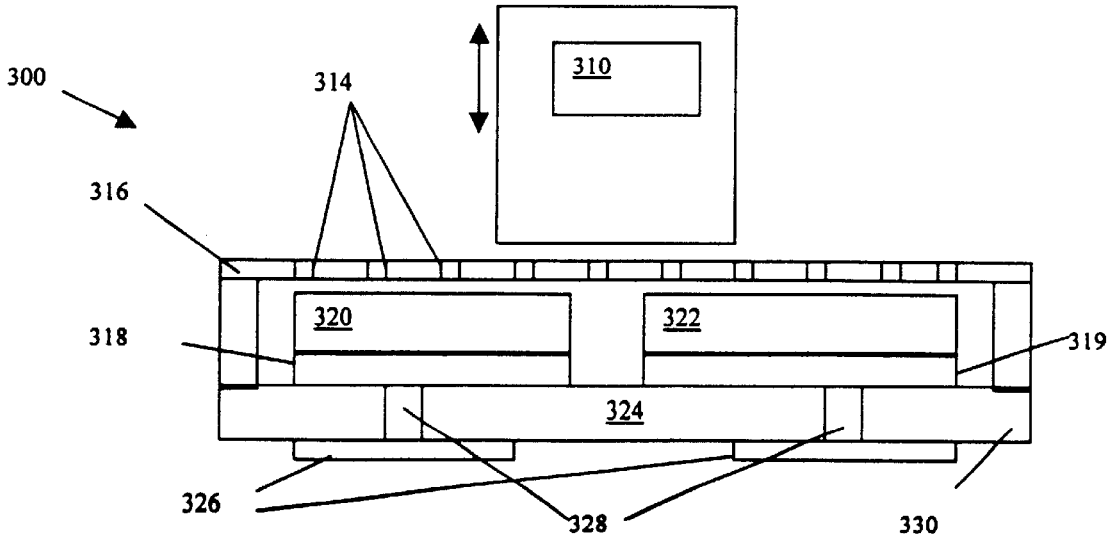
FIG. 11 is a diagram of the contact substrate and the shorting bar of a sealed liquid metal contact filled lateral MEM micro-relay substrate in the open position in another alternative embodiment of the present invention.
Figure 12:
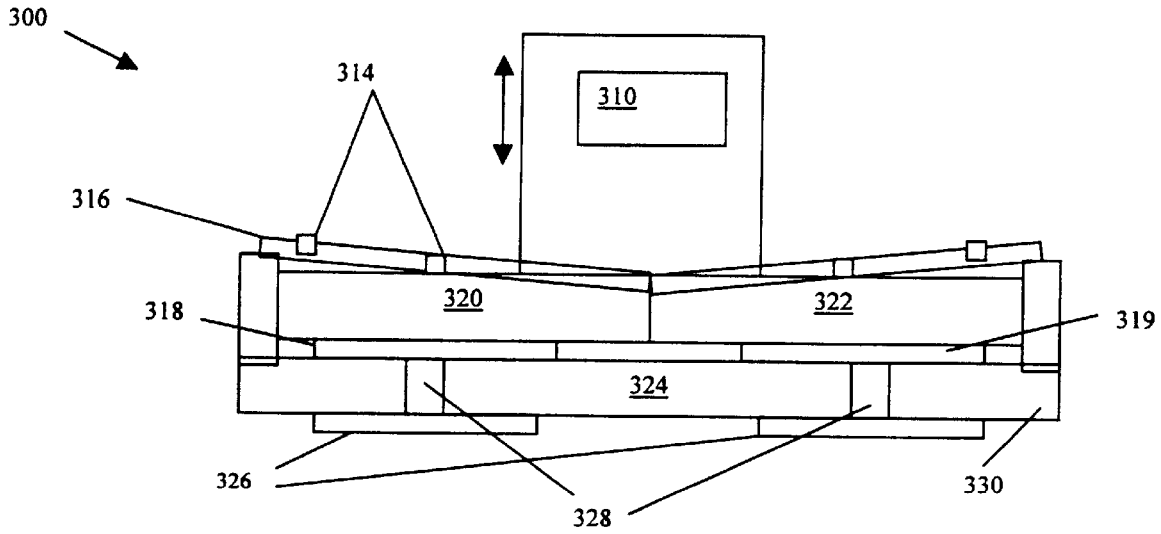
FIG. 12 is a diagram of the contact substrate and the shorting bar of a sealed liquid metal contact filled lateral MEM micro-relay substrate in the closed position in another alternative embodiment of the present invention.

Referring now to FIGS. 11 and 12, a MEM relay 300 is a modified version of the MEM relays 258 and 286 with an open system contact structure as shown in FIGS. 8, 9, and 10. MEM relay 300 includes a closed contact region and actuator structure having a sealed liquid metal contact system. FIG. 11 shows the MEM relay 300 in an open position.

The MEM relay 300 includes a sealed liquid metal contact system including actuator 310 which is spaced apart from a non-wetting metal shorting membrane 316 when the MEM relay 300 is in an open position. The non-wetting metal shorting membrane 316 can include a set of gas vents 314.

A set of wettable contacts 318 and 319 are fabricated in a shallow well in the contact substrate 324. A flexible membrane 316 has been placed over the contact area. There are small gas vents 314 in the flexible membrane 316 to allow for pressure equalization during switch operation, and as a result of temperature changes. The gas vents 314 are small enough so the surface tension of the liquid metal contacts 320 and 322 does not allow it to escape through the gas vents 314. Gas vent 314 are not required if there is no need to equalize pressures or speed the switching time of the switching action. The actuator 310 pushes the membrane 316 into the liquid metal contacts 320 and 322 to close the MEM relay 300, as shown in FIG. 12. Preferably the membrane 316 is conductive, and the membrane 316 electrically contacts each of the liquid metal contacts 320 and 322 to close the switch. In alternate embodiment having a non-conductive membrane 316, the actuator 310 pushes on the membrane 316 with sufficient force to cause the two liquid metal contacts 320 and 322 to come together to close the MEM relay 300. Typically, the membrane 316 should be non-wetting to avoid bridging of the contact system. The MEM relay 300 is opened by withdrawing the actuator 310, which releases the force holding the two liquid metal contacts 320 and 322 by the restoration spring force of the membrane 316, together and allows surface tension to restore the two liquid metal contacts to a non-connecting state. The liquid metal contacts 320 and 322 must be placed far apart enough that the surface tension of the liquid metal will result in separation of the liquid metal into two separate liquid metal contacts 320 and 322 when the MEM relay 300 is opened.

The main escape mechanism for the liquid metal used in the liquid metal contacts 320 and 322 is through vaporization and escape through the gas vents 314. If there is a significant reservoir of the liquid metal, the life of the liquid metal contacts 320 and 322 is greatly extended. The rest of the MEM relay 300 must not be degraded by the recondensing of the liquid metal vapor onto the various surfaces of the interior. If the MEM relay 300 is fully sealed, as previously described, there is no external release of the liquid metal vapor. If the contact region is sealed, without gas vents 314, then there is no escape of the liquid metal vapor outside of the sealed contact region.

FIG. 12 shows the MEM relay 300 contact region and actuator structure of FIG. 11 in a closed position with the non-wetting metal shorting membrane 316 forcing the two liquid metal contacts 320 and 322 to forced together to close the MEM relay 300. This contact structure could be substituted for the contact structure used in the MEM relay 130 of FIG. 5, replacing the shorting bar 132 and liquid metal contacts 150 and 154 (FIG. 5).

MEM relay 300 can include a heater (not shown) disposed on contact substrate 324 near the liquid metal contacts 320 and 322 to keep the liquid metal contacts 320 and 322 from solidifying.

Figure 13:
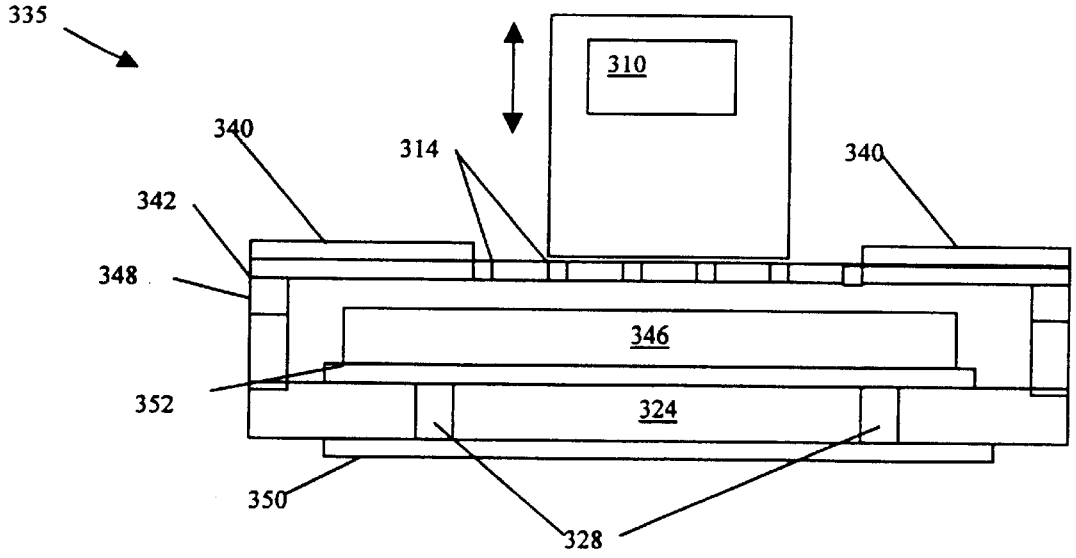
FIG. 13 is a diagram of the contact substrate and the non-wetting metal contact membrane of a single contact sealed liquid metal filled MEM micro-relay substrate in the open position in another alternative embodiment of the present invention.

Now referring to FIG. 13, a single contact sealed structure MEM relay 335 contact region including an actuator substrate 310 and contact substrate 324 is shown. MEM relay 335 includes a single wettable metal signal contact 352 spaced apart from a non-wetting but conductive membrane 342 disposed on the contact substrate 324. A liquid metal contact 346 is deposited on the single wettable metal contact 352. External signal contacts 340 are disposed on the non-wetting but conductive membrane 342. Gas vents 314 are disposed on the non-wetting but conductive membrane 342. A set of vias 328 are disposed on the contact substrate 324. An external signal contact 350 is disposed on the contact substrate 324 and electrically connected to the wettable metal signal contact 352 through the vias 328.

In operation, the actuator 310 pushes the membrane 342 into the liquid metal contact 346 to close the MEM relay 335. The membrane 342 is conductive, and it touches the liquid metal contact 346 to close the MEM relay 335. Closing the MEM relay 335 electrically connects the external signal contacts 340 and 350. The MEM relay 335 is opened by withdrawing the actuator 310, which releases the force holding the membrane against the liquid metal contact 346 and allows surface tension to restore the liquid metal contact 346 to a non-connecting state. The gas vents 314 allow pressure equalization and prevent the escape of the liquid metal.

MEM relay 335 can include a heater (not shown) disposed on contact substrate 324 near the liquid metal contact 346 to keep it from solidifying.

Figure 14:
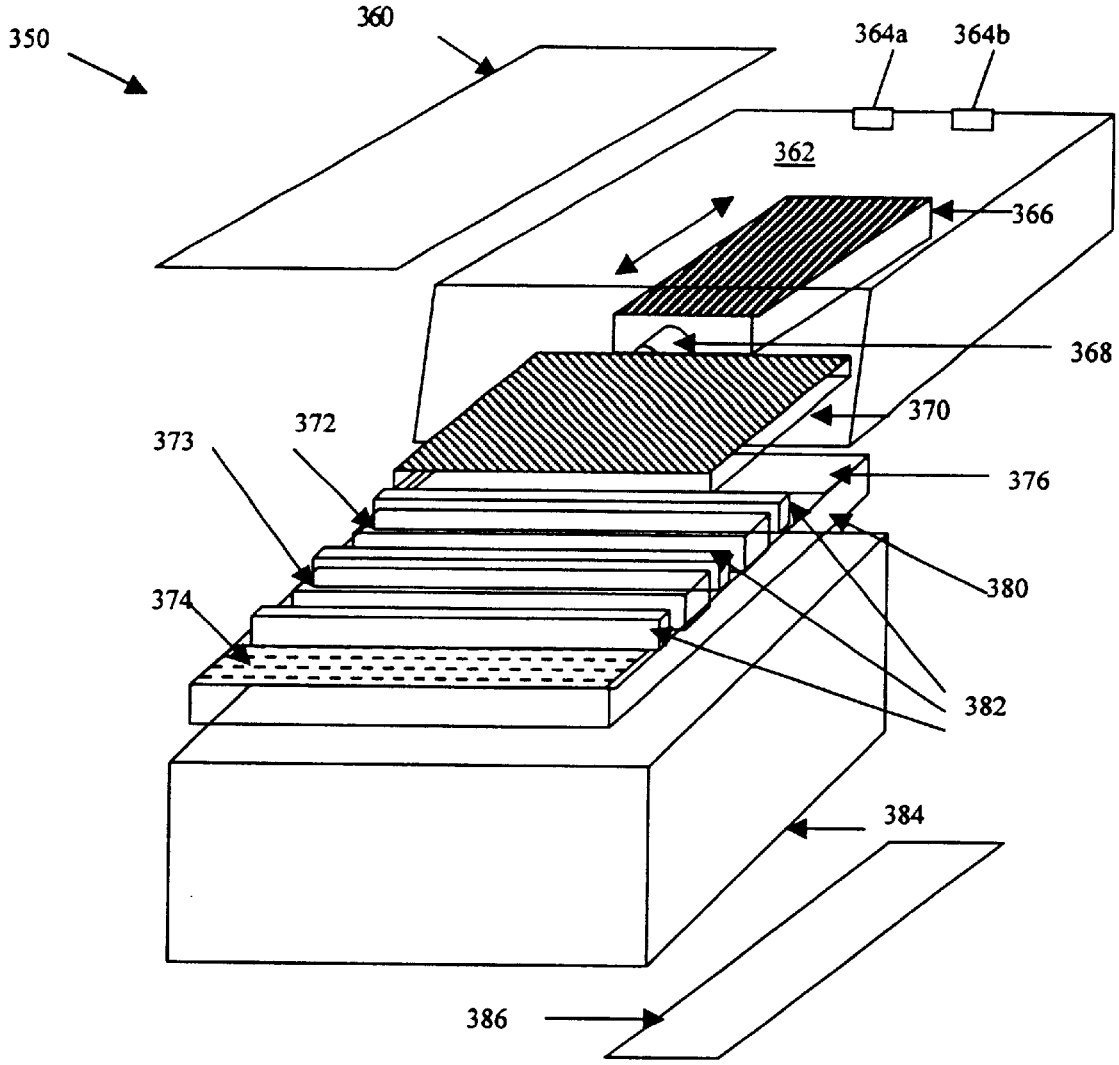
FIG. 14 is a diagram of a lateral sliding liquid metal contact MEM micro-relay substrate in the open position in another alternative embodiment of the present invention.

Referring now to FIG. 14, a lateral sliding liquid metal contact system MEM relay 350 is shown. The liquid metal contact MEM relay 400 includes a lateral actuator 366 is disposed on an actuator fabrication substrate 362 and connected to a conductive sliding non-wetting shorting bar 370 by means of an insulated actuation arm 368. The actuator fabrication substrate 362 has external actuator control contacts 364*a* and 364*b* for coupling a signal to control the actuator 366. MEM relay 400 also includes contact fabrication substrate 380 that can either be bonded to or co-fabricated with actuator fabrication substrate 362. A set of liquid metal contacts 372 and 373 separated by insulators 382 are all disposed on the contact fabrication substrate 380. A pair of signal contacts 374 and 376 are fabricated on the surface of the contact fabrication substrate 380 and are electrically connected to the two liquid metal contacts 372 and 373 respectively.

In operation, the non-wetting shorting bar 370 can slide across two liquid metal contacts 372 and 373 which are separated and contained by insulators 382 on the sides and by the contact fabrication substrate 380 below. The non-wetting shorting bar 370 moves parallel to a plane formed by the two liquid metal contacts 372 and 373.

As the lateral actuator 366 changes the position of the shorting bar, it alternately engages both the liquid contacts to complete the electrical circuit or engages only one (or none) of the liquid contacts to open the circuit. The not-wetting shorting bar 370 slides along the top surface of the (non-wetting) insulators 382 separating the two liquid metal contacts 372 and 373. If the sliding shorting bar 370 is wetted by the liquid metal contacts 372 and 373, friction and wear may be reduced and there may be improved conduction due to liquid metal-to-liquid metal contact, but the control of liquid metal bridging between the contacts must be prevented. The bridging problem is overcome by an adequate spacing between the two liquid metal contacts 372 and 373, a sufficient lateral actuator 366 throw length, and an adequate surface tension of the liquid metal. The non-wetting properties of the contact fabrication substrate 380 are also important in overcoming the bridging problem.

This system can be sealed if there is a flexible sealing membrane (not shown) between the sliding non-wetting shorting bar 370 and the actuator insulator. Such a sealing membrane (not shown) will separate the actuation sections from the liquid metal sections. This will control the migration of the liquid metal out of the contact section into the actuator fabrication substrate 362.

It should be appreciated that contact structure of MEM relay 350 can be adapted to a variety of actuators, and to a variety of actuator motions.

It should also be appreciated that there are other configurations of the MEM relay 350 which can include, in one embodiment, a contact heating system 384 in thermal contact with the contact fabrication substrate 380. A top cover 360 and a bottom cover 386 can enclose the MEM relay 350.

It should be appreciated that while the above embodiments have generally been shown as having two liquid metal contacts in preferred embodiments, the MEM relays can be fabricated with alternate shorting bar and contact configurations to provide, for example, multiple contact MEM relays. Those skilled in the art will appreciate that numerous contact and actuator configurations are achievable the using MEM relay fabrication techniques described below.

All publications and references cited herein are expressly incorporated herein by reference in their entirety.

Having described the preferred embodiments of the invention, it will be apparent to one of ordinary skill in the art that other embodiments incorporating their concepts may be used. For example, MEM relays including a plurality of liquid metal contacts, alternate liquid metal contact arrangements and alternate actuator structures can incorporate the concepts of the present invention. It is felt, therefore, that these embodiments should not be limited to the disclosed embodiment but rather should be limited only by the spirit and scope of the appended claims.

What is claimed is:

1. A MEM relay comprising:

an actuator;

a non-wetting shorting bar disposed on said actuator;

a contact substrate, having an upper surface and a lower surface, in a spaced apart relationship with said non-wetting shorting bar;

a first liquid metal contact disposed on said upper surface of said contact substrate;

a first signal contact disposed on said lower surface of said contact substrate;

a first via having an outside surface and an interior surface coated with liquid metal, passing through said contact substrate, and placing said first liquid metal contact and said first signal contact in electrical communication when the MEM relay is in a closed state; a second liquid metal contact disposed on said upper surface of said contact substrate;

a second signal contact disposed on said lower surface of said contact substrate; and a second via having an outside surface and an interior surface coated with liquid metal, passing through said contact substrate, and placing said second liquid metal contact and said second signal contact in electrical communication when the MEM relay is in a closed state.

2. The MEM relay of claim 1, wherein the non-wetting shorting bar has a conductive metal surface.

3. The MEM relay of claim 1, wherein the non-wetting shorting bar is a non-conductive membrane.

4. The MEM relay of claim 1, wherein the non-wetting shorting bar is a liquid motion bar.

5. The MEM relay of claim 1, wherein the non-wetting shorting bar is a non-wetting metal shorting membrane.

6. The MEM relay of claim 5 wherein the non-wetting metal shorting membrane further comprises a plurality of gas vents.

7. A MEM relay comprising:

an actuator;

a shorting bar disposed on said actuator;

a contact substrate;

a plurality of liquid metal contacts disposed on said contact substrate such that said plurality of liquid metal contacts are placed in electrical communication when the MEM relay is in a closed state; and at least one heater disposed on said contact substrate wherein said heater is in thermal communication with said plurality of liquid metal contacts.

8. The MEM relay as recited in claim 7, wherein the contact substrate further comprises a plurality of wettable metal contacts disposed on said contact such that each of said wettable metal contact is proximate to each of said plurality of liquid metal contacts and each of said wettable metal contact is in electrical communication with each of said plurality of liquid metal contacts.

9. The MEM relay as recited in claim 7, wherein said shorting bar further comprises a non-wetting metal surface disposed on said shorting bar.

10. The MEM relay as recited in claim 7, wherein said shorting bar is a non-conductive liquid motion bar.

11. The MEM relay as recited in claim 7, wherein said shorting bar is a non-wetting metal shorting membrane.

12. The MEM relay as recited in claim 11, wherein said non-wetting metal shorting membrane further comprises a plurality of gas vents.

13. The MEM relay as recited in claim 7, wherein each of said plurality of wettable metal contacts includes an excess of liquid metal such that a droplet of liquid metal is formed on each of plurality of wettable metal contacts.

14. The MEM relay as recited in claim 7, wherein said shorting bar is a non-wetting metal shorting membrane.

15. The MEM relay as recited in claim 7, wherein said shorting bar is a cantilevered non-wetting metal shorting membrane.

16. A MEM relay comprising:

an actuator;

an actuator spacer movably disposed on said actuator;

a shorting bar disposed on said actuator spacer;

a contact substrate, having an upper surface and a lower surface, spaced apart from said shorting bar;

a plurality of wettable metal contacts disposed on said upper surface of said contact substrate;

a plurality of liquid metal contacts disposed on said plurality of wettable metal contacts such that said plurality of wettable metal contacts are placed in electrical communication when the MEM relay is in a closed state;

a plurality of external contacts disposed on said lower surface of said contact substrate; and a plurality of conducting vias placing each of said plurality of wettable metal contacts in electrical communication with a respective one of said plurality of external contacts.

17. The MEM relay as recited in claim 16, wherein said shorting bar further comprises a plurality of gas vents.

18. The MEM relay as recited in claim 16, wherein said shorting bar further comprises a non-wetting metal surface disposed on said shorting bar.

19. The MEM relay as recited in claim 16, wherein said shorting bar is a non-conductive liquid motion bar.

20. The MEM relay as recited in claim 16, wherein said shorting bar is a non-wetting metal shorting membrane.

21. The MEM relay as recited in claim 20, wherein said non-wetting metal shorting membrane further comprises a plurality of gas vents.

22. The MEM relay as recited in claim 16, wherein each of said plurality of wettable metal contacts includes an excess of liquid metal such that a droplet of liquid metal is formed on each of plurality of wettable metal contacts.

23. The MEM relay as recited in claim 16, wherein said shorting bar is a non-wetting metal shorting membrane.

24. The MEM relay as recited in claim 16, wherein said shorting bar is a cantilevered non-wetting metal shorting membrane.

25. The MEM relay as recited in claim 16, wherein said actuator spacer electrically insulates said shorting bar from said actuator.

26. A MEM relay comprising:

an actuator;

a non-wetting metal shorting membrane, having an outer surface and an inner surface; disposed on said actuator;

a plurality of upper external contacts disposed on said outer surface of said non-wetting metal shorting membrane;

a contact substrate, having an upper surface and a lower surface, spaced apart from and insulated from said non-wetting metal shorting membrane;

a liquid metal contact disposed on said upper surface of said contact;

a plurality of lower external contacts disposed on said lower surface of said contact substrate such that at least one of said plurality of lower external contacts is placed in electrical communication with at least one of said plurality of upper external contacts when the MEM relay is in a closed state; and a plurality of conducting vias placing each of said plurality wettable metal contacts in electrical communication with a respective one of said plurality of lower external contacts.

27. The MEM relay as recited in claim 26, wherein said non-wetting metal shorting membrane further comprises a plurality of gas vents.

* * * * *

UNITED STATES PATENT AND TRADEMARK OFFICE

CERTIFICATE OF CORRECTION

PATENT NO. : 6,396,371 B2
DATED : May 28, 2002
INVENTOR(S) : Streeter et al.

It is certified that error appears in the above-identified patent and that said Letters Patent is hereby corrected as shown below:

Title page,
Item [57], ABSTRACT,
Line 13, delete “wettable metal contact” and replace with -- wettable metal contacts --.

Column 2,
Line 54, delete "down to toward" and replace with -- down toward --.

Column 3,
Line 43, delete "of an radio" and replace with -- of a radio --.

Column 4,
Line 27, delete "microrelay" and replace with -- micro-relay --.
Line 30, delete "microrelay" and replace with -- micro-relay --.
Line 34, delete "A MEM" and replace with -- a MEM --.
Line 46, delete "wettable metal contact" and replace with -- wettable metal contacts --.

Column 5,
Line 12, delete "can be is" and replace with -- is --.
Line 19, delete "a actuator" and replace with -- an actuator --.

Column 7,
Line 41, delete "MEM relay 100 relay" and replace with -- MEM relay 100 --.

Column 8,
Line 36, delete "down to toward" and replace with -- down toward --.

Column 9,
Line 48, delete "micromelting" and replace with -- micro-melting --.
Line 55, delete "microrelay" and replace with -- micro-relay --.
Line 59, delete "microrelay" and replace with -- micro-relay --.

Column 10,
Line 2, delete "microweld" and replace with -- micro-weld --.
Line 62, delete "micromachining" and replace with -- micro-machining --.

UNITED STATES PATENT AND TRADEMARK OFFICE

CERTIFICATE OF CORRECTION

PATENT NO. : 6,396,371 B2
DATED : May 28, 2002
INVENTOR(S) : Streeter et al.

It is certified that error appears in the above-identified patent and that said Letters Patent is hereby corrected as shown below:

Column 12,
Line 18, delete "on outside" and replace with -- on an outside --.
Line 21, delete "micomachined" and replace with -- micro-machined --.
Line 24, delete "micromachining" and replace with -- micro-machining --.

Column 13,
Line 43, delete "is with respect" and replace with -- is coplanar with respect --.
Line 61, delete "microrelay" and replace with -- micro-relay --.

Column 14,
Line 2, delete "the liquid metal the signal" and replace with -- the liquid metal signal --.
Line 21, delete "shown) and at both" and replace with -- shown) at both --.
Line 33, delete "vee-shaped" and replace with -- v-shaped --.
Line 39, delete "vee-shaped" and replace with -- v-shaped --.
Line 42, delete "vent 260 are" and replace with -- vent 260 is --.

Column 15,
Line 9, delete "vee shape" and replace with -- v-shaped --.
Line 15, delete "vee shape" and replace with -- v-shaped --.
Line 56, delete "are not" and replace with -- is not --.

Column 16,
Line 27, delete "to forced together" and replace with -- together --.

Column 17,
Line 25, delete "not-wetting" and replace with -- non-wetting --.

Signed and Sealed this

Nineteenth Day of November, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,396,371 B2
DATED : May 28, 2002
INVENTOR(S) : Streeter et al.

It is certified that error appears in the above-identified patent and that said Letters Patent is hereby corrected as shown below:

Column 1,
Line 19, delete “mechanism” and replace with -- mechanisms --.

Column 7,
Line 44, delete “104 bonded” and replace with -- 104 and a bonded --.
Line 45, delete “as an contact” and replace with -- as a contact --.

Column 8,
Line 56, delete “122 beam” and replace with -- beam 122 --.

Column 9,
Line 38, delete “wettable metal contact” and replace with -- wettable metal contacts --.
Line 48, delete “contact 126” and replace with -- contacts 126 --.

Column 12,
Line 21, delete “via 194 is an aperture” and replace with -- vias 194 are an aperture --.
Line 22, delete “via 194 is an access” and replace with -- vias 194 are an access --.
Line 24, delete “the via 194 may” and replace with -- the vias 194 may --.
Line 26, delete “The via 194 is placed” and replace with -- the vias 194 are placed --.
Line 28, delete “via 194 area is” and replace with -- vias 194 surface area are --.
Line 30, delete “source though the” and replace with -- source through the --.

Column 14,
Line 21, delete “FIG. 7)” and replace with -- FIG. 8) --.
Line 57, delete “contacts, the liquid metal” and replace with -- contacts 274 and 275, the liquid metal --.

Column 15,
Line 3, delete “contact 275.” and replace with -- contact 275, through the metal shorting, bar 264 --.
Line 7, delete “bar can be” and replace with -- bar 262 (FIG. 9) can be --.
Line 8, delete “metal making which makes” and replace with -- metal which makes --.
Line 10, delete “without a conducting metal layer is” and replace with -- without a shorting bar 262 is --.
Line 54, delete “not allow it to escape” and replace with -- not allow the liquid metal to escape --.
Line 55, delete “Gas vent 314” and replace with -- Gas vents 314 --.
Line 56, delete “pressures or speed the switching time” and replace with -- pressures or increase the speed of the switcing time --.
Line 62, delete “close the switch” and replace with -- close the MEM relay 300 --.

UNITED STATES PATENT AND TRADEMARK OFFICE

CERTIFICATE OF CORRECTION

PATENT NO. : 6,396,371 B2
DATED : May 28, 2002
INVENTOR(S) : Streeter et al.

It is certified that error appears in the above-identified patent and that said Letters Patent is hereby corrected as shown below:

Column 16,
Line 35, delete “solidifying” and replace with -- solidifying, in low temperature conditions --.
Line 42, delete “deposited on the” and replace with -- deposited in the --.
Line 64, delete “solidifying” and replace with -- solidifying in low temperature conditions --.

Column 17,
Line 1, delete “relay 400 includes” and replace with -- relay 350 includes --.
Line 1, delete “366 is” and replace with -- 366 which is --.
Line 2, delete “disposed on an actuator” and replace with -- disposed within an actuator --.
Line 7, delete “relay 400 also” and replace with -- relay 350 also --.
Line 23, delete “liquid contacts” and replace with -- liquid contacts 372 and 373 --.
Line 25, delete “contacts to open” and replace with -- contacts 372 and 373 to open --.
Line 28, delete “bar 370 is wetted by” and replace with -- bar 370 is wettable and is wetted by --.
Line 31, delete “but the control of liquid” and replace with -- but liquid --.
Line 32, delete “contacts must be” and replace with -- contacts 372 and 373 must be --.

Signed and Sealed this

Twentieth Day of May, 2003

JAMES E. ROGAN
*Director of the United States Patent and Trademark Office*